US008517116B2

(12) United States Patent
Wagner

(10) Patent No.: US 8,517,116 B2
(45) Date of Patent: Aug. 27, 2013

(54) INERTIZATION METHOD FOR PREVENTING FIRES

(75) Inventor: Ernst Werner Wagner, Winsen/Aller (DE)

(73) Assignee: Amrona AG, Zug (CH)

( * ) Notice: Subject to any disclaimer, the term of this patent is extended or adjusted under 35 U.S.C. 154(b) by 525 days.

(21) Appl. No.: 11/795,798

(22) PCT Filed: Nov. 3, 2005

(86) PCT No.: PCT/EP2005/011773
§ 371 (c)(1),
(2), (4) Date: Mar. 10, 2008

(87) PCT Pub. No.: WO2006/076936
PCT Pub. Date: Jul. 27, 2006

(65) Prior Publication Data

US 2008/0196907 A1 Aug. 21, 2008

(30) Foreign Application Priority Data

Jan. 21, 2005 (EP) ..... 05001224

(51) Int. Cl.
*A62C 2/00* (2006.01)

(52) U.S. Cl.
USPC ..... 169/45; 169/46

(58) Field of Classification Search
USPC ..... 169/43–46, 54, 64; 62/340, 78
See application file for complete search history.

(56) References Cited

U.S. PATENT DOCUMENTS

| | | | | |
|---|---|---|---|---|
| 4,091,874 | A | 5/1978 | Monma | |
| 5,799,495 | A | 9/1998 | Gast et al. | |
| 6,314,754 | B1 * | 11/2001 | Kotliar | 62/640 |
| 6,341,572 | B1 * | 1/2002 | Howell et al. | 114/230.12 |
| 6,401,487 | B1 * | 6/2002 | Kotliar | 62/640 |
| 6,871,645 | B2 * | 3/2005 | Wartman et al. | 128/203.12 |
| 7,179,322 | B2 * | 2/2007 | Lyons et al. | 95/47 |
| 7,231,808 | B2 * | 6/2007 | Wagner | 73/31.02 |
| 2002/0040940 | A1 | 4/2002 | Wagner et al. | |
| 2003/0226669 | A1 | 12/2003 | Wagner | |
| 2008/0196907 | A1 | 8/2008 | Wagner | |

FOREIGN PATENT DOCUMENTS

| | | |
|---|---|---|
| CN | 1427733 | 7/2003 |
| DE | 42 23 781 | 1/1994 |
| DE | 198 11 851 | 9/1999 |
| EP | 0 436 487 | 7/1991 |
| EP | 1 172 127 | 1/2002 |
| EP | 1 312 392 | 5/2003 |
| EP | 1 475 128 | 11/2004 |
| GB | 1 385 122 | 2/1975 |
| GB | 2 374 007 | 10/2002 |
| JP | 9-276428 A | 10/1997 |
| JP | 11 076445 | 3/1999 |

(Continued)

*Primary Examiner* — Davis Hwu
(74) *Attorney, Agent, or Firm* — Jean C. Edwards, Esq.; Edwards Neils PLLC

(57) ABSTRACT

An inertization method for preventing fire or explosion in a first enclosed protected area by lowering the oxygen content in the protected area to a base inertization level relative-to the ambient air. With the objective of eliminating any danger to people or processes within the protected area, the method according to the invention provides for measuring the oxygen content in the protected area, comparing it to a threshold (maximum inertization level), and in the event it falls below the threshold (maximum inertization level), introducing fresh air into the protected area(s).

8 Claims, 3 Drawing Sheets

(56) References Cited

FOREIGN PATENT DOCUMENTS

| | | | |
|---|---|---|---|
| JP | 2001-46536 | A | 2/2001 |
| JP | 2003-71640 | A | 3/2003 |
| JP | 2003-102858 | A | 4/2003 |
| JP | 2003102858 | | 4/2003 |
| JP | 2008-528073 | | 7/2008 |
| RU | 2200044 | C2 | 3/2003 |
| RU | 2212262 | C2 | 9/2003 |
| SU | 955946 | | 9/1982 |
| SU | 1151246 | A | 4/1985 |
| WO | WO 01/78843 | | 10/2001 |
| WO | WO 01/78843 | A2 | 10/2001 |
| WO | WO 2004/080540 | | 9/2004 |

* cited by examiner

INERTIZATION METHOD FOR PREVENTING FIRES

CROSS-REFERENCE TO RELATED APPLICATIONS

The present invention is a 35 USC 371 national stage entry of international application No. PCT/EP2005/11773 filed Nov. 3, 2005, which claims priority from European Patent Application No. EP 05001224.4, filed Jan. 21, 2005, the contents of which are herein incorporated by reference in their entirety.

FIELD OF THE INVENTION

The present invention relates to an inertization method for preventing fire or explosion in an enclosed protected area by lowering the oxygen content in the protected area relative to the ambient air in the protected area.

BACKGROUND

Inertization methods for preventing and extinguishing fires in closed spaces are known in firefighting technology. The resulting extinguishing effect of these methods is based on the principle of oxygen displacement. As is generally known, normal ambient air consists of 21% oxygen by volume, 78% nitrogen by volume and 1% by volume of other gases. To extinguish or prevent fires, an inert gas of pure or 90% nitrogen is introduced, for example, to further increase the nitrogen concentration in the protected area at issue and thus lower the oxygen percentage. An extinguishing effect is known to occur when the percentage of oxygen falls below about 15% by volume. Depending on the inflammable materials contained within the respective protected area, further lowering of the oxygen percentage to, e.g., 12% by volume may additionally be necessary. Most inflammable materials can no longer burn at this oxygen concentration.

The oxygen-displacing gases used in this "inert gas extinguishing method" are usually produced by a device, or are stored compressed in steel canisters in specific adjacent areas. Inert gas mixtures of, for example, 90%, 95% or 99% nitrogen (or another inert gas) are used in this method. The steel canisters or the device to produce the oxygen-displacing gas constitutes the so-called primary source of the inert gas fire-extinguishing system. In case of need, the gas is then channeled from this source through a pipeline system and the corresponding outlet nozzles into the respective protected area. In order to keep the fire risk as low as possible should the primary source fail, secondary sources of inert gas are occasionally employed as well.

All the methods known to date for increasing the safety of such inert gas extinguishing fire prevention systems focus on preventing the flow of gas necessary to maintain an inertization concentration. Thus, there are an existing number of mechanisms which specify the different inert gas sources for the primary, as well as for any potentially provided and safety-increasing secondary inert gas sources. The secondary inert gas source will then kick in when the primary inert gas source fails.

However, a common shortcoming in all of these mechanisms and methods is that none have a safety mechanism in the event of an uncontrolled continuation of inert gas inflow, even when the inertization level has since reached a value which unfailingly prevents fires.

However, having an inert gas concentration which is too high can occur when an inadvertent equalization of the inertization gas concentration level occurs due to leakage between adjacent areas of differing inertization levels. A conceivable further shortcoming would be the failure of the control mechanism governing the supply of inert gas or the generator used to produce the inert gas, not turning off or the supply valve no longer having a tight seal and continuing to let inert gas flow into the protected area.

The reason for a high inertization level with yet an equivalently relatively high oxygen content can be rooted in the fact that either people are occupying the protected area or that it must be possible for people to enter the protected area even when an increased concentration of inertization gas is used to prevent fires. The continuous inflow of inertization gas into the protected area thus, not only results in higher costs for the continuous production of inert gas or the release of inert gas from primary and/or secondary sources, but it also affects particularly critical issues relative the safety of the people within the protected area.

Accordingly, based on the problems described above in safely engineering an inert gas fire extinguishing system, an inertization method which can reliably reduce inertization concentrations which are too high, or which are too high for specific requirements such as personnel entering the protected area, is needed.

SUMMARY OF THE INVENTION

Exemplary embodiments consistent with the present invention relate to an inertization method for preventing fire or explosion in an enclosed protected area by lowering the oxygen content in the protected area relative to the ambient air in the protected area, in order to reliably reduce inertization concentrations which are too high, or which are too high for specific requirements such as personnel entering the protected area.

Exemplary embodiments consistent with the present invention include an inertization method in which the oxygen content in the protected area is continually measured, compared to a threshold (maximum inertization level), and in the event it—unintentionally—falls below the threshold (maximum inertization level), fresh air is introduced into the protected area.

In the present case, the term "fresh air" also refers to oxygen-reduced air but which has a higher oxygen content than that within the protected area.

One advantage of the present invention is the achievement of a simple to realize and thereby very effective inertization method for preventing fire in an enclosed area, even in the event of an uncontrolled flow of inert gas due to a technical failure of the inert gas production or inert gas supply system. In addition, a sufficient volume of fresh air is provided around the protected area. The disadvantages of prior known mechanisms and methods, which can involve endangering the people within the protected area, are clearly avoided.

In one embodiment, the threshold for the oxygen content at which fresh air is introduced into the protected area is lower than the oxygen content value at the base inertization level. This distinguishing between types of oxygen contents is expedient since the oxygen content selected for the base inertization level will prevent fire yet still allow people to enter the protected area. Should the oxygen content drop further due to a malfunctioning excessive supply of inert gas, while fire will continue to be prevented, it becomes increasingly dangerous for people to remain in the room. The threshold for the oxygen content in the protected area is thus to be selected such that it is lower than the oxygen content of the base inertization level, yet does not drop below a value which would be dangerous to people.

Alternatively to measuring the oxygen content in the protected area, the inert gas content in the protected area can also be measured. In this case, the inert gas content is then compared to a threshold and when it exceeds the same, fresh air is introduced into the protected area. This method assumes a direct relationship between oxygen content and inert gas content in the natural atmosphere. This dependency is known in typical fire prevention situations.

The oxygen content in the protected area is advantageously measured at several locations with respectively one or a plurality of sensors. One advantage to measuring the oxygen content at a plurality of locations is that a value falling below a threshold at one location is promptly detected even in the event of non-uniform oxygen concentrations. A further advantage in using a plurality of sensors is redundancy. Should a sensor be defective or the line to a sensor be disrupted, another sensor can take over the measurement task.

In the event that running cables to the various sensors would be problematic, the sensors can also send signals to the control unit wirelessly.

Alternatively to measuring the oxygen content at one or more locations, the inert gas content in the protected area can also be measured at one or more locations with one or a plurality of inert gas sensors respectively. One advantage in taking measurements at a plurality of locations is the advantage of measuring the oxygen concentration at a plurality of locations. It is expressly pointed out that simultaneously measuring both the oxygen content as well as the inert gas content considerably increases the safety of the people within the protected area.

In one advantageous further embodiment consistent with the present invention, the signals from the oxygen and/or inert gas sensors are fed to a control unit. Advantageously, all the electronic components required to evaluate the sensor signals are centralized in this control unit. Different algorithms can also be provided in the control unit to respond to the different gas mixture concentrations.

In another advantageous embodiment, the control unit can furthermore switch a fresh air supply system on and off. Incorporating the control logic for the fresh air supply system in the control unit also reflects the compact-design criterion for consolidating all the measurement and control signals into one electronic unit.

The fresh air supply is advantageously regulated so as not to exceed a maximum inertization level; nor is the base inertization level undercut. This means that the oxygen concentration within the protected area is also regulated even when fresh air is supplied such that fire is reliably prevented at a base inertization level. Important hereto is that the fresh air supply is switched on—at the latest—upon reaching a maximum inertization level which would pose a danger to the people within the protected area.

In a further advantageous embodiment of the invention, the control unit monitors a second protected area. This second protected area is also allocated a fresh air supply system, at least one oxygen sensor and/or at least one inert gas sensor, and a zone valve to control the supply of inert gas. It is also ensured that a maximum inertization level is not exceeded in this second protected area nor, conversely, is a base inertization level undercut. The advantage to distinguishing different inertization levels between different protected areas involves enabling different possibilities for people to enter the areas.

Although there are different protected areas, all the measurement and control lines are centralized in one control unit. The advantage here is simpler maintenance and a compact design to the whole of the signal and evaluation electronics for various protected areas.

It can advantageously be further provided for the control unit to set the base and the maximum inertization levels at different levels for each protected area. For example, the oxygen content at the base inertization level in a particular protected area can be lower than the corresponding value in another protected area. The advantage to such a differentiation would be to allow people to remain in one protected area while the oxygen content in the other area is selected so low such that it would not be possible for people to remain in the area. This segregation would be conceivable when easily flammable materials are stored in one protected area and materials of normal flammability in another protected area where people regularly come and go.

The foregoing summary has outlined some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

BRIEF DESCRIPTION OF THE DRAWINGS

The above and further advantages of the present invention my be better understood by referring to the following description taken in conjunction with the accompanying drawings, in which.

DETAILED DESCRIPTION OF EXEMPLARY EMBODIMENTS

Figure 1:
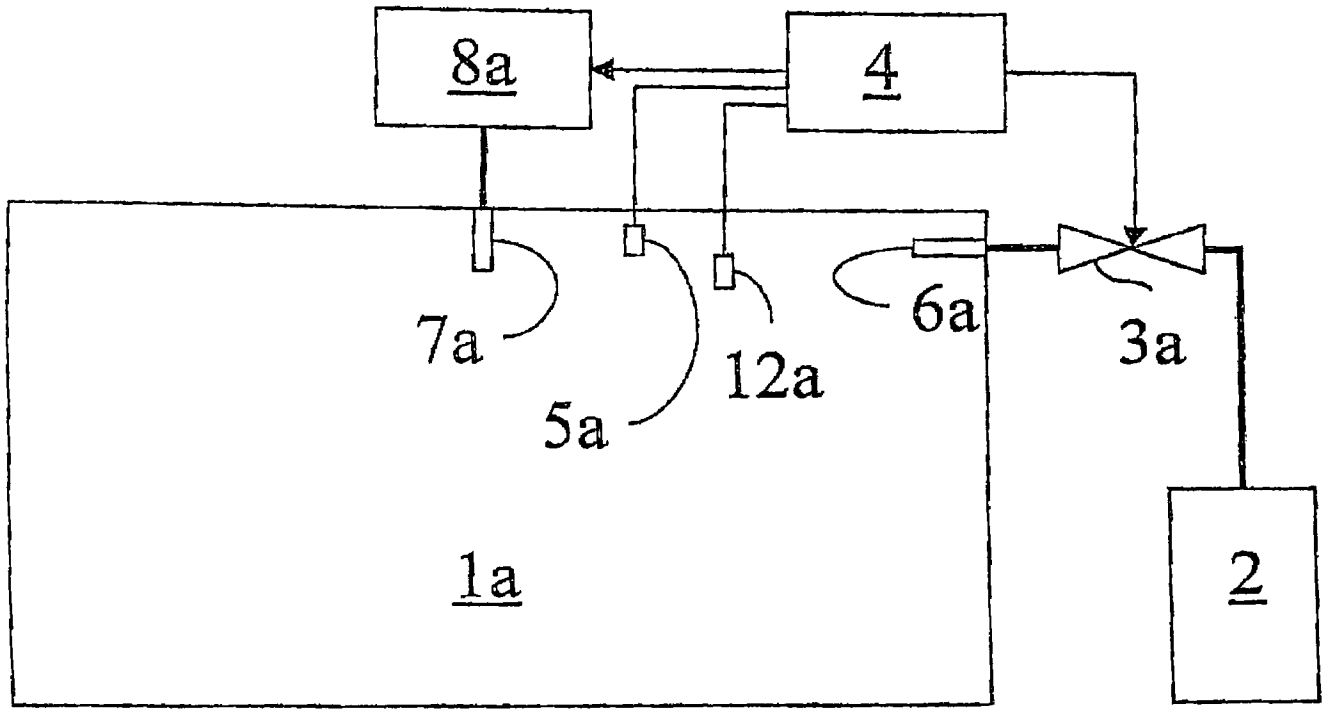
FIG. 1 is a schematic representation of a protected area with its associated inert gas sources as well as the valve, measuring and control mechanisms, fresh air supply system and the inlet nozzles for the fresh air supply system.

The schematic representation of FIG. 1 shows an example of the basic functioning of the method according to the invention including the associated control and measurement systems. The piping is thereby depicted as thick bold lines and the measurement/control lines are depicted as normal thin lines.

The inert gas can be released from the inert gas source 2, through a valve 3*a*, and one or more outlet nozzles 6*a* into protected area 1*a*. The inert gas source can hereby be of diverse design. A typical arrangement is to provide the inert gas from one or a plurality of containers, for example steel cylinders. Alternatively, a generator can be used to produce an inert gas (nitrogen, for example) or an inert gas/air mixture. It is also conceivable for the primary gas source to be redundantly configured for the purpose of increasing safety; i.e., a secondary inert gas source is accessed as needed which consists in turn either of compressed inert gas in steel cylinders or comes from an inert gas-producing generator.

The concentration of the inert gas in protected area 1*a* is regulated by control unit 4 which in turn acts on valve 3*a*. Control unit 4 is set such that a base inertization level is reached in protected area 1*a*. This base inertization level reduces the risk of fire or explosion in protected area 1*a* and is maintained by introducing inert gas into protected area 1*a* from inert gas source 2 through valve 3*a* and inert gas inlet nozzle 6*a*.

In the event this system arrangement should fail—if, e.g., valve 3*a* does not close or the generator producing the inert gas or the inert gas/air mixture does not switch off, and thereby continuously allows inert gas to enter the protected area through inert gas inflow 6*a*, with the inert gas concentration thereby continuously rising in the protected area such that the oxygen content falls far below the desired base inertization level—the following mechanism according to one embodiment consistent with the present invention, is set in motion.

Upon control unit 4 measuring an oxygen concentration which is too low, by means of oxygen sensor 5*a*, control unit 4 emits in consequence thereof, a signal to close valve 3*a* or a signal to shut off the generator producing the inert gas or inert gas/air mixture. Once these two conditions are met and the oxygen concentration in protected area 1*a* falls even further, which can also be signaled to control unit 4 by inert gas sensors 12*a*, the fresh air supply system 8*a* is activated, releasing additional fresh air into protected area 1*a* by way of one or more fresh air supply inlets 7*a*. The inflow volume of fresh air is thereby set such that even at maximum operation of the inert gas-producing system (configured either as gas cylinders or a generator), the inert gas concentration in protected area 1*a* cannot continue to rise. This therefore ensures the desired oxygen concentration in protected area 1*a*, even if the control unit governing the inert gas inflow into protected area 1*a* should fail. Fires are thus reliably prevented and yet people can still remain in protected area 1*a* as need be without fearing any adverse effects.

Figure 2:
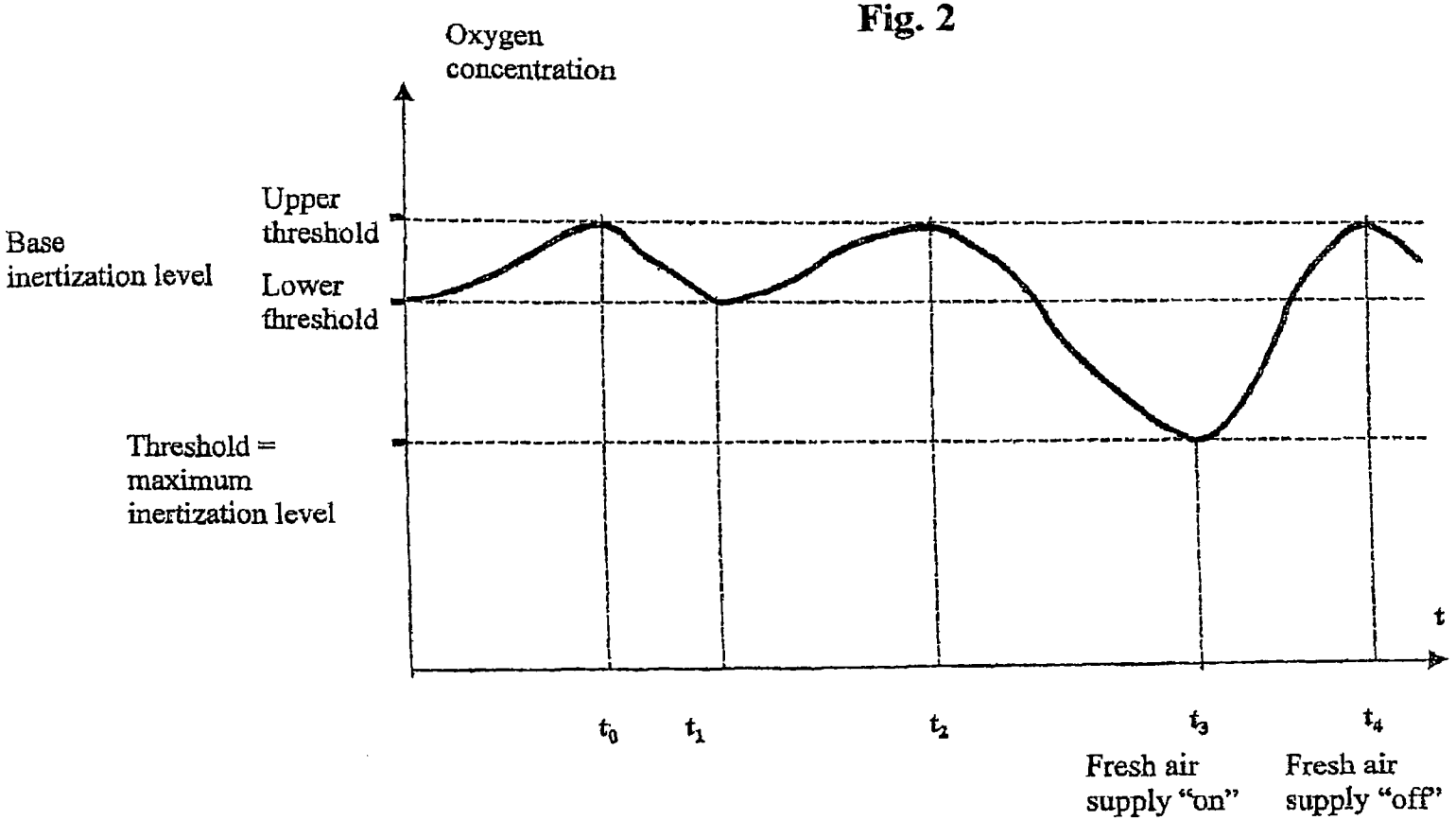
FIG. 2 is an example sequence of the oxygen concentration in the protected area.

FIG. 2 depicts an exemplary embodiment of a sequence to the oxygen concentration in protected area 1*a* The oxygen concentration is regulated to a base inertization level (target value), between an upper and a lower target value. The inert gas source is activated and inert gas introduced into protected area 1*a* at time point $t_o$. As a result of this introduction of inert gas into protected area 1*a*, the oxygen concentration drops between time points $t_o$ and $t_1$. The inert gas source is again deactivated at time point $t_1$. The oxygen concentration continues to slowly rise again up until time point $t_2$, because, e.g., some fresh air enters the protected area due to leakage relative to the ambient air. Thus, the inert gas source is re-activated at time point $t_2$.

Should some defect prevent the inert gas source from being deactivated, however, the oxygen concentration would continue to drop in the protected area. The maximum inertization concentration allowed for protected area 1*a* and which is still safe for people is reached at time point $t_3$. Should the inert gas system malfunction; i.e., an unhindered continued inflow of inert gas moves into the protected area—the oxygen concentration will continue to drop past time point $t_3$, which would make the protected area unsafe for human occupancy. By means of the controlled inflow of fresh air according to one exemplary embodiment of the present invention, starting at time point $t_3$, there is no drop below the maximum inertization level; i.e., the oxygen concentration in the protected area remains above the maximum inertization level.

An emergency alarm (not shown in the Figure) can also be provided, to be triggered at any time point. The base inertization level at which fires are reliably prevented is re-attained at time point $t_4$. In order to maintain protection against fire, the fresh air supply is switched off again at time point $t_4$.

Figure 3:
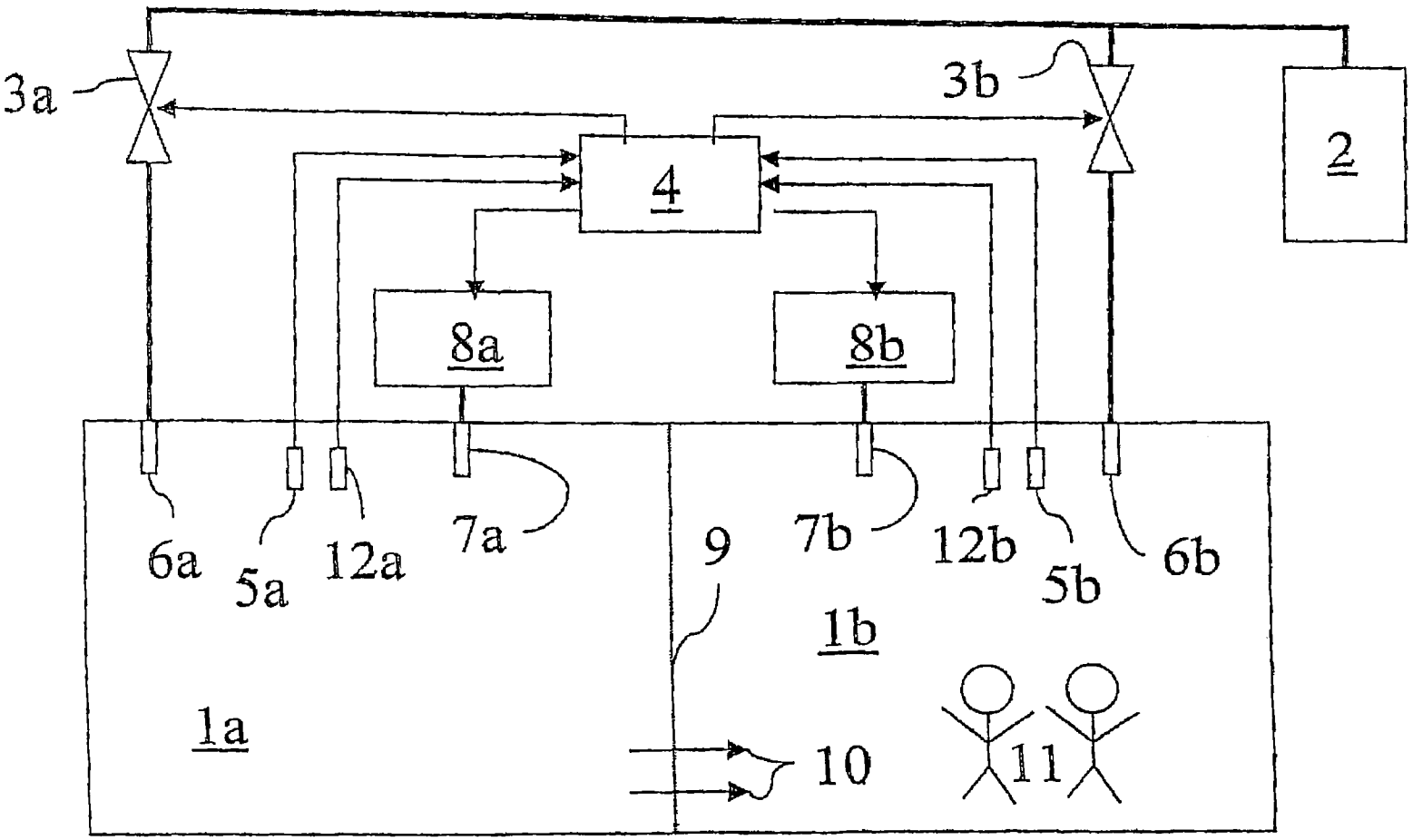
FIG. 3 is a schematic representation of an inertization system including two areas and zone-specific inertizing components.

FIG. 3 shows a further exemplary embodiment of the present invention of an inertization system which in this case includes two protected areas 1*a* and 1*b* and zone-specific inertizing and monitoring components. Protected area 1*a* is monitored in this case according to the details as given relative the description of FIGS. 1 and 2. A further protected area 1*b* with associated inertizing and monitoring components is additionally depicted. Said components encompass valve 3*b*, inert gas inlet 6*b*, oxygen sensor 5*b*, fresh air supply inlet 7*b* and the fresh air supply system 8*b*.

Alternatively, the control unit 4 depicted in FIG. 3 could also consist of two separate control units. The two protected areas 1*a*, 1*b* are separated from one another by a wall 9. Alternatively, the control unit 4 depicted in FIG. 3 could also consist of two separate control units.

Protected area 1*a*, to which people do not have access in this exemplary embodiment has a different (higher) inertization level than protected area 1*b* which, despite inertization, has people coming and going on a regular basis. Protected area 1*a* could have an inertization level at which the oxygen concentration is at 13% by volume, for example. In contrast thereto, control unit 4 ensures a different inertization level for protected area 1*b*, for example with the oxygen at 17% by volume. Because of the permeableness of wall 9, inert gas could pass uncontrolled from protected area 1*a* to protected area 1*b*. This is depicted in FIG. 3 by directional arrows 10.

The function of control unit 4 is to guarantee the different inertization levels in protected areas 1*a* and 1*b* by supplying inert gas through valves 3*a* and 3*b* and supplying fresh air as necessary through the fresh air systems 8*a* and 8*b* and the fresh air supply inlets 7*a* and 7*b*, as was detailed in the description relative to FIG. 1. Valves 3*a* and 3*b* are also referred to as zone valves in this case since the different protected areas 1*a* and 1*b* constitute different monitored areas.

It should be emphasized that the above-described embodiments of the invention are merely possible examples of implementations set forth for a clear understanding of the principles of the invention. Variations and modifications may be made to the above-described embodiments of the invention without departing from the spirit and principles of the invention. All such modifications and variations are intended to be included herein within the scope of the invention and protected by the following claims.

The invention claimed is:

1. A method for preventing fire or explosion in a first enclosed protected area and/or a second enclosed protected area, comprising:

lowering an oxygen content in at least one of the protected areas relative to ambient air, to a base inertization threshold level which corresponds to an oxygen content which allows people to safely occupy the protected area;

measuring the oxygen content in the at least one of the protected areas at one or more locations with respectively one or more oxygen sensors;

upon measuring an oxygen content which is below the base inertization threshold level and which reaches a maximum inertization concentration level;

shutting off a supply of inert gas or inert gas/air mixture into the at least one of the protected areas; and introducing fresh air into the at least one of the protected areas, thereby ensuring that the oxygen content in the at least one of the protected areas remains above the maximum inertization concentration level, wherein the oxygen content does not drop below the maximum inertization level by introducing the fresh air; and wherein the introduction of fresh air is stopped as soon as the oxygen content in the at least one of the protected areas reaches again the base inertization level.

2. The method according to claim 1, further comprising:

lowering the oxygen content in the at least one of the protected areas by introducing an oxygen-displacing inert gas or an inert gas/air mixture;

measuring the inert gas/mixture content in the at least one of the protected areas;

comparing said inert gas/mixture content to an inert gas/mixture threshold, and introducing fresh air into the at least one of the protected areas upon the inert gas/mixture threshold being exceeded.

3. The method according to claim 2, further comprising:

measuring the inert gas/mixture content in the at least one of the protected areas at one or more locations with respectively one or more inert gas sensors.

4. The method according to claim 1, wherein the measured values for the oxygen content and the inert gas/mixture content respectively, are fed to a control unit.

5. The method according to claim 4, wherein a fresh air supply system supplies the fresh air, and the control unit can switch the fresh air supply system on and off.

6. The method according to claim 5, wherein a supply of the fresh air is regulated such that a pre-controllable maximum inertization level will not be undercut and the base inertization level will not be exceeded.

7. The method according to claim 6, wherein there are at least two protected areas, and said control unit monitors the second protected area as to oxygen content by use of said fresh air supply system, said at least one oxygen sensor, said at least one inert gas sensor, a zone valve, an inert gas inlet, and a fresh air inlet, such that the maximum inertization level is not undercut and a base inertization level is not exceeded.

8. The method according to claim 7, wherein the control unit regulates the oxygen content in the at least one of the protected areas such that at the maximum inertization level, said oxygen content is higher in the second protected area than in the first protected area.

* * * * *